US005417195A

United States Patent [19]

Tachikawa et al.

[11] Patent Number: 5,417,195

[45] Date of Patent: May 23, 1995

[54] ENGINE INDUCTION SYSTEM

[75] Inventors: Kenichi Tachikawa; Shinji Seike, both of Higashihiroshima, Japan

[73] Assignee: Mazda Motor Corporation, Hiroshima, Japan

[21] Appl. No.: 238,337

[22] Filed: May 4, 1994

Related U.S. Application Data

[63] Continuation of Ser. No. 35,266, Mar. 22, 1993, abandoned.

[30] Foreign Application Priority Data

Mar. 24, 1992 [JP] Japan ..... 4-066224

[51] Int. Cl.[6] ..... F02B 23/00

[52] U.S. Cl. ..... 123/585; 123/184.21

[58] Field of Search ..... 123/184.21, 184.53, 123/339, 585

[56] References Cited

U.S. PATENT DOCUMENTS 5,107,800 4/1992 Araki et al. ..... 123/52 MB

FOREIGN PATENT DOCUMENTS 59-54749 3/1984 Japan ..... 123/585

63-141832 9/1988 Japan .

OTHER PUBLICATIONS

Hiroshi Arai, An Electronic System for an Automobile, Aug. 5, 1992, Japan, p. 18.

*Primary Examiner*—Noah P. Kamen

*Attorney, Agent, or Firm*—Fish & Richardson

[57] ABSTRACT

In an engine induction system, a drive frequency f1 of an ISC valve 13 for duty control and a characteristic frequency f2 of an intake passage between an air cleaner 8 and a throttle valve 11 are set so as to obtain a relationship: $(\frac{3}{4})f1 \leqq f2 \leqq (5/4)f1$. In this set system, a resonance chamber 17 is connected to the intake passage between the air cleaner 8 and the throttle valve 11 to thereby deaden the vibration caused by the driving of the ISC valve 13. Accordingly, the engine induction system is allowed to prevent the amplification of the vibration accompanying the actuation of the ISC valve so as to prevent the deterioration of the detection accuracy of an airflow meter while being allowed to meet requirements such as an improvement in the responsiveness when the ISC valve disposed in an ISC pipe is duty controlled.

2 Claims, 7 Drawing Sheets

ENGINE INDUCTION SYSTEM

This application is a continuation of Ser. No. 08/035,266, filed Mar. 22, 1993, now abandoned.

BACKGROUND OF THE INVENTION

1. Field of the Invention

This invention relates to an engine induction system including an intake passage provided with a diffuser, a detector for detecting an amount of intake air, a throttle valve, and a bypass pipe having a duty controlled control valve disposed therein.

2. Discussion of the Related Art

There has been known an induction system including an intake passage provided with an air cleaner, an airflow meter for detecting an amount of intake air, and a throttle valve, and having a resonance chamber connected thereto so as to reduce noises generated in taking the intake air into an engine (for example, refer to Japanese Unexamined Utility Model Publication No. 63-141832). In the system of this type, the resonance chamber or the like is provided so as to obtain a function such as a muffling effect of deadening the pulsation according to an intake cycle in a specific engine speed region due to the resonance.

There has been also known an induction system in which an ISC pipe bypassing a throttle valve is provided and an ISC valve is disposed in the ISC pipe for an idle speed control. The ISC valve is duty controlled to control a flow rate of intake air in the ISC pipe. The induction system of this type suffers from the following problem since no consideration has been conventionally made on the influence of the vibrations generated when the ISC valve is duty controlled.

In many of the conventional systems in which the ISC valve is duty controlled, a drive frequency of the duty control is set relatively low so as to obtain a high level of reliability. Accordingly, the drive frequency of the duty control is generally sufficiently lower than a characteristic frequency of the intake passage. However, a recent trend has been such that the drive frequency of the duty control is set to a given high level so as to improve the accuracy and responsiveness of the idle speed control particularly in engines having a large cubic capacity. Thus, the drive frequency of the duty control may approximate to the characteristic frequency of the intake passage between the air cleaner and the throttle valve. In this case, the vibration accompanying an intermittent air flow caused by the ISC valve duty controlled in an idle speed region is amplified due to the resonance in the intake passage, thereby being transmitted to the airflow meter. Influenced by the above vibration, an output of the airflow meter may carry an error particularly when the highly sensitive air flow meter such as a hot-wire type, is used.

SUMMARY OF THE INVENTION

In view of the problem residing in the prior art, an object of the invention is to provide an engine induction system capable of preventing the amplification of the vibration caused by the actuation of an ISC valve and the deterioration in the detection accuracy of an airflow meter while meeting requirements such as an improvement in the responsiveness in a duty control of the ISC valve.

Accordingly, the invention is directed to an engine induction system comprising an intake passage; a diffuser positioned upstream from the intake passage; a detector means disposed downstream from the diffuser for detecting an amount of intake air flowing through the intake passage; a throttle valve disposed downstream from the detector means; a bypass pipe bypassing the throttle valve; and a control valve for controlling a flow rate in the bypass pipe, the control valve being duty controlled according to an operating state of an engine; a resonance chamber whose characteristic frequency is substantially equal to a drive frequency of the control which valve for the duty control is advantageously connected to the intake passage between the diffuser and the throttle valve; and the drive frequency and a characteristic frequency of the intake passage between the diffuser and the throttle valve are set so as to obtain the following relationship: $(\frac{3}{4})f1 \leqq f2 \leqq (5/4)f1$ where f1 denotes the drive frequency and f2 denotes the characteristic frequency.

With this constructed system, under the condition where the vibration caused by the driving of the control valve is amplified in an idle operating state due to the resonance in the intake passage, this vibration can be deadened by the resonance chamber.

The drive frequency may be set higher than the characteristic frequency of the intake passage between the diffuser and the throttle valve by a specified value or larger.

With this constructed system, there can be prevented an occurrence of event where the vibration caused by the driving of the control valve is amplified in the idle operating state due to the resonance in the intake passage. In addition, the responsiveness of the duty control of the control valve and the like can be improved.

The above constructions are particularly effective when the detector means is a hot-wire airflow meter.

These and other objects, features and advantages of the present invention will become more apparent upon a reading of the following detailed description and accompanying drawings.

DETAILED DESCRIPTION OF THE PREFERRED EMBODIMENTS

Hereafter, preferred embodiments of the invention will be described with reference to the accompanying drawings.

Figure 1:
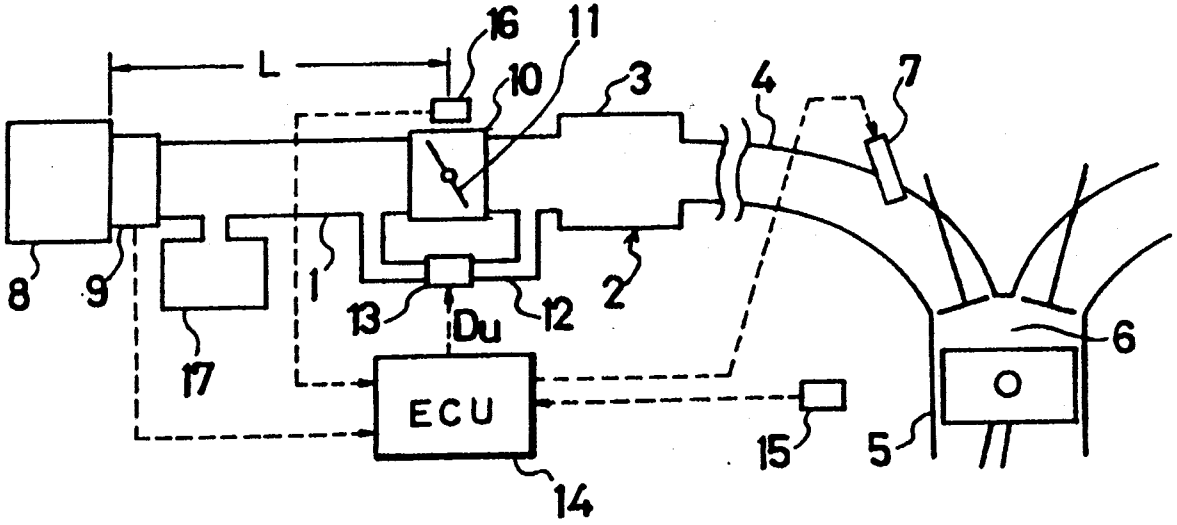
FIG. 1 is a schematic diagram showing an entire induction system as an embodiment of the invention.
Figure 2:
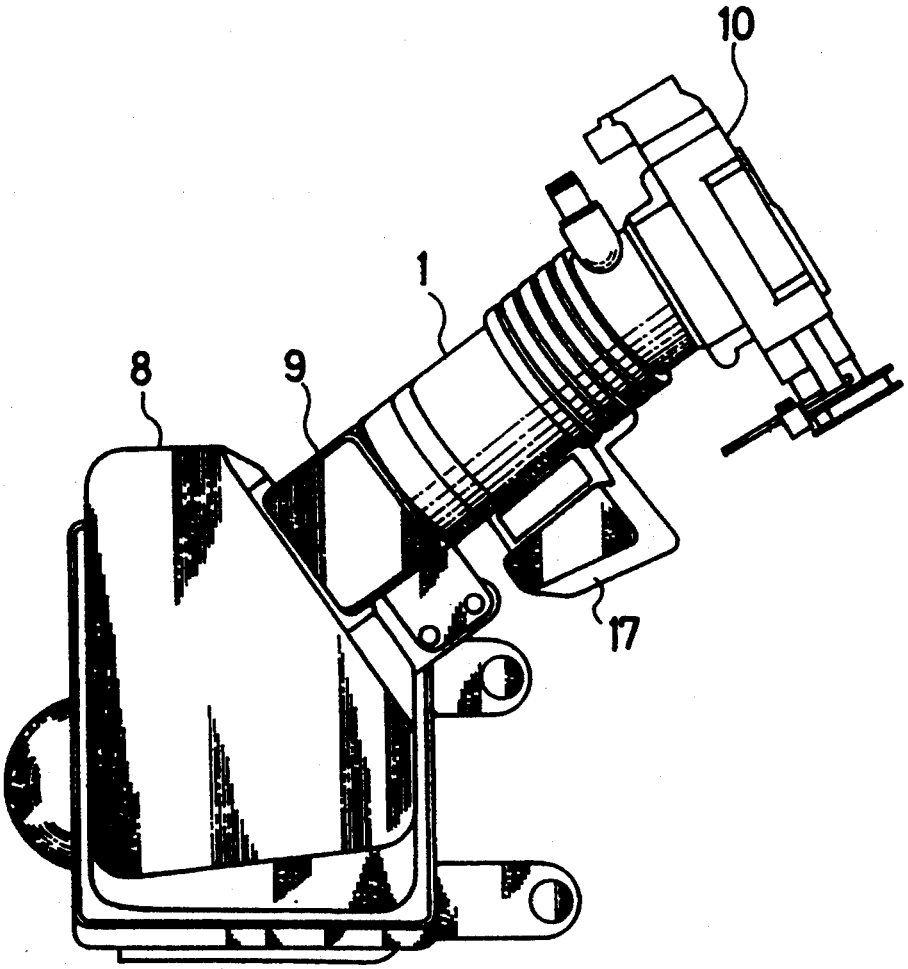
FIG. 2 is a plan view showing an upstream intake passage.
Figure 3:
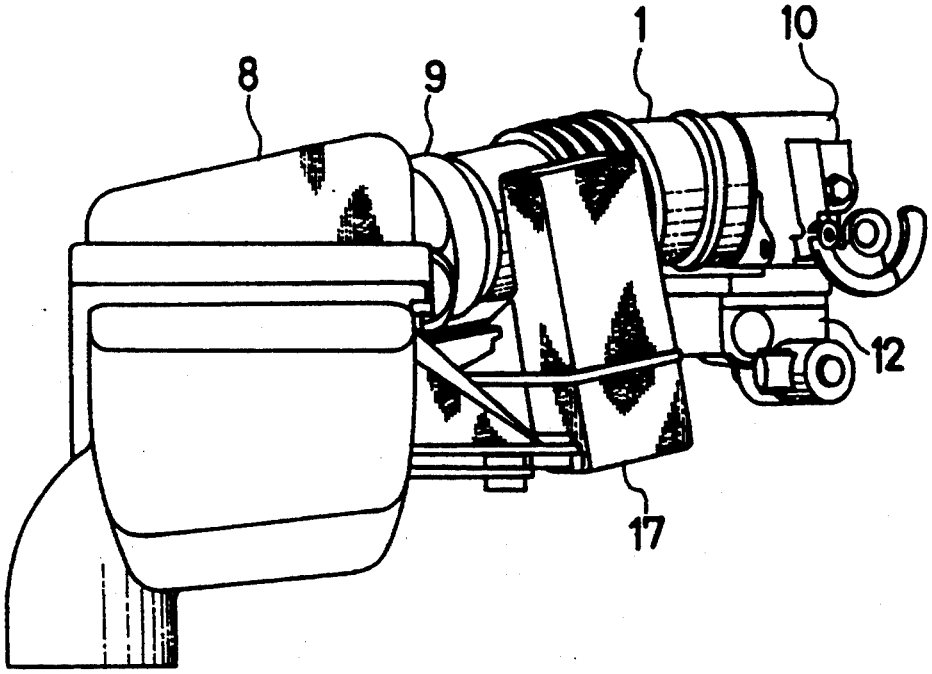
FIG. 3 is a front view showing the upstream intake passage.

FIG. 1 shows schematically an entire induction system as an embodiment of the invention, and FIGS. 2, 3 show a specific structure of a portion of an intake passage between an air cleaner and a throttle box in the same embodiment. In this embodiment, the intake passage consists essentially of an upstream intake passage 1 common for respective cylinders, and an intake manifold 2 including a surge tank 3 and individual intake runners 4 extending individually from the respective cylinders to the surge tank 3. Downstream ends of the individual intake runners 4 are connected to inlet ports open to combustion chambers 6 of the respective cylinders defined in an engine main body 5. An injector 7 for injecting fuel is disposed at a specified position along each individual intake runner 4 near the inlet port.

The upstream intake passage 1 has an air cleaner 8 serving as a diffuser connected to an upstream end thereof. An air flow meter (intake air amount detector) 9 is provided in the vicinity of the upstream end of the passage 1. Downstream from the upstream intake passage 1 is provided a throttle box 10 incorporating a throttle valve 11. The intake manifold 2 is connected with a downstream side of the throttle box 10. In this embodiment, the airflow meter 9 is of the hot-wire type in which a heat resistance wire is disposed in an air flowing section so as to detect a change in the resistance value.

In the intake passage is further provided an ISC pipe 12 (bypass pipe) for supplying the air while bypassing the throttle valve 11 so as to adjust an idle speed. The ISC pipe 12 is provided below the throttle box 10, and an upstream end thereof is open to the upstream intake passage 1 immediately upstream from the throttle box 10 and a downstream end thereof is opened to the intake passage downstream from the throttle box 10. In the ISC pipe 12 is disposed an ISC valve (control valve) 13 for controlling an amount of air flow passing through the ISC pipe 12.

The ISC valve 13 is controlled according to an operating state by a control unit 14 including a microcomputer and the like. The injectors 7 are also controlled by the control unit 14, and an amount of fuel injected therefrom is controlled in accordance with an intake air amount detection signal output from the airflow meter 9 and the like. To the control unit 14 are input an engine speed detection signal from an engine speed sensor 15 and a throttle opening detection signal from the throttle opening sensor 16 in addition to the signal from the airflow meter 9.

The control unit 14 sends a duty signal Du representing a preset drive frequency to the ISC valve 13 to close and open the ISC valve 13, thereby executing a duty control of adjusting a ratio of an open period to a close period of the ISC valve 13. In the idle operating state, a flow rate in the ISC pipe 12 is controlled by means of the duty control according to a difference between a detected engine speed and a target idle speed. In this way, a feedback control is executed to bring the engine speed closer to the target idle speed. In other than the idle speed region, the ISC valve 13 is controlled at a set duty according to the operating state, for example, during the deceleration.

An ISC drive frequency f1 which is a drive frequency of the duty control is set so as to meet the requirement for the high responsiveness of the control. A length of the upstream intake passage 1 relating to a characteristic frequency f2 of the intake passage between the air cleaner 8 and the throttle valve 11 is set in consideration of the layout of the engine. The ISC drive frequency f1 and the length of the intake passage are set, such that a relationship between the ISC drive frequency f1 and the characteristic frequency f2 is $(\frac{3}{4})f1 \leqq f2 \leqq (5/4)f1$.

In this set induction system, a resonance chamber 17 is connected to the upstream intake passage 1 between the air cleaner 8 and the throttle valve 11. The resonance chamber 17 is in communication with the upstream intake passage 1 in a position downstream from the airflow meter 9 and upstream from the upstream end of the ISC pipe 12. The resonance chamber 17 is sealed except for a portion in communication with the upstream intake passage 1. The characteristic frequency of the resonance chamber 17 is substantially equal to the ISC drive frequency f1.

The operation of the system of this embodiment will now be specifically described below.

The intake passage portion between the air cleaner 8 serving as a diffuser and the throttle valve 11 can be considered as an air column having one end closed and the other end opened in the idle operating state and the low load operating state where the throttle valve 11 is closed. Accordingly, if the passage length between the air cleaner 8 and the throttle valve 11 is assumed to be L, the characteristic frequency f2 thereof is:

$$f2 = n \times C/(4L)$$

where C denotes a sound velocity ($C = 331.5 + 0.61\theta$ when the ambient temperature is assumed to be $\theta$) and n denotes a positive integer.

When the ISC valve 13 is operated by means of the duty control in the idle operating state, the vibration is generated when the valve 13 is opened and closed. The frequency of the vibration is the ISC drive frequency f1. When the ISC drive frequency f1 is equal to or approximates the characteristic frequency f2 of the upstream intake passage 1, the vibration accompanying the actuation of the ISC valve 13 is amplified due to the resonance in the upstream intake passage 1. Transmission of this vibration to the airflow meter 9 causes an error in the output of the airflow meter 9. Being sensitive to the variation of the intake air flow caused by the vibration, the hot-wire airflow meter is particularly liable to carry an error in its output.

Figure 4:
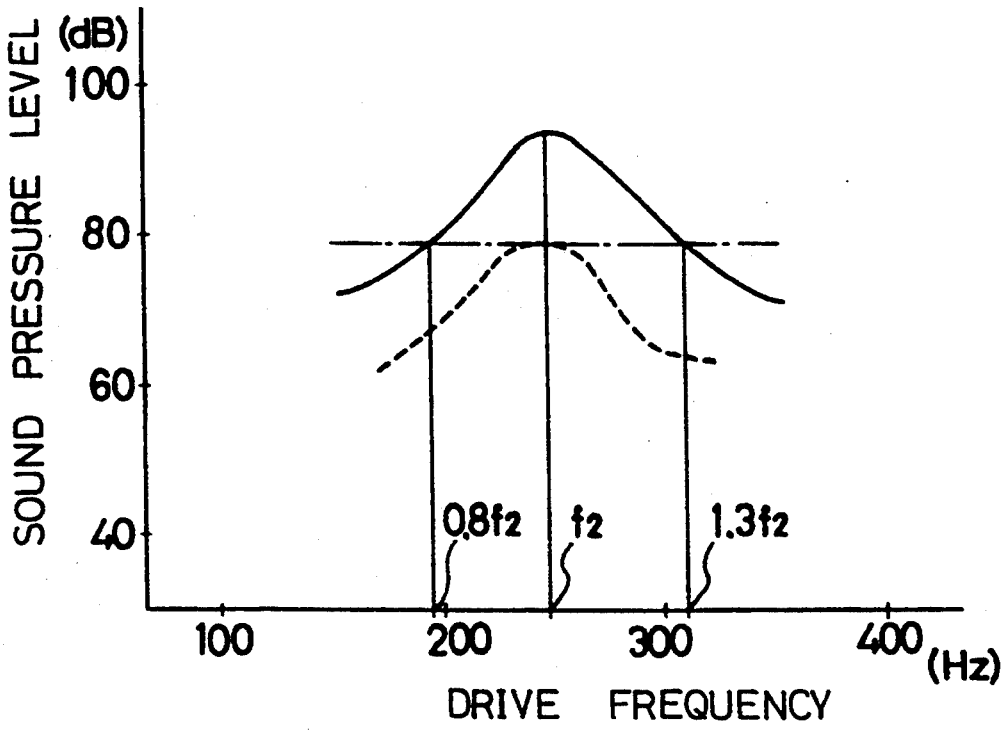
FIG. 4 is a graph showing a sound pressure level as related to a drive frequency.
Figure 5:
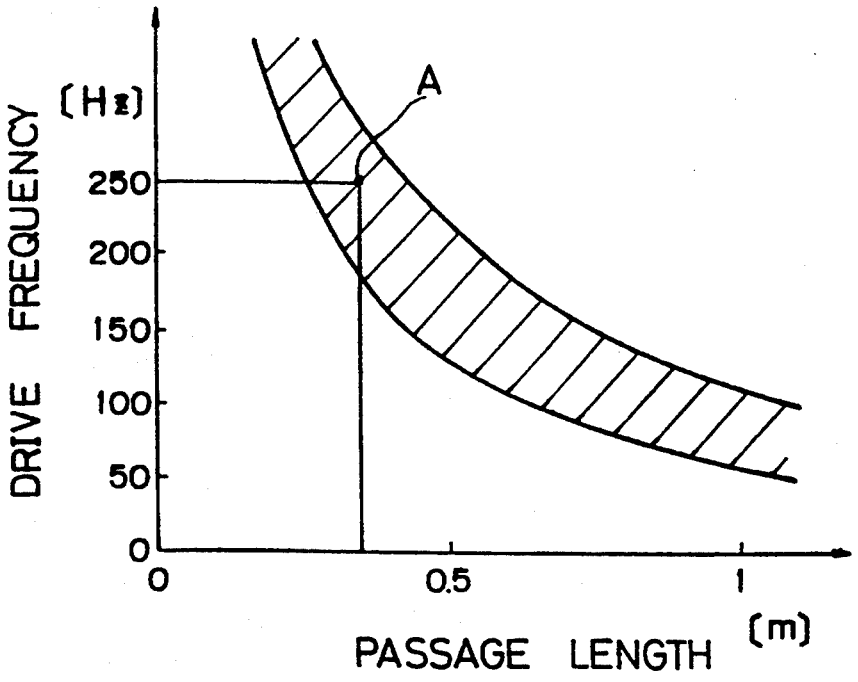
FIG. 5 is a graph showing a zone where the vibration caused by the driving of an ISC valve becomes problematic, wherein an horizontal axis represents an intake passage length while a vertical axis represents an ISC drive frequency.

FIG. 4 shows the empirically obtained intensities of the vibration at various frequencies, wherein a horizontal axis represents the ISC drive frequency f1 and a vertical axis represents a sound pressure level. The sound pressure level peaks due to the resonance where the ISC drive frequency f1 is equal to the characteristic frequency f2 of the upstream intake passage 1. Reduction of about 15 dB brings the peak sound pressure level to a peak sound pressure level (broken line) when the ISC valve is closed. When this level (indicated by alternate long and short dash line) is used as a reference, the sound pressure level is higher than this reference level in a range where the ISC drive frequency f1 takes about 0.8 f2 to 1.3 f2. Accordingly, the vibration caused by the driving of the ISC valve 13 becomes problematic when the ISC drive frequency f1 and the characteristic frequency f2 of the upstream intake passage 1 are related to obtain the relationship: $(\frac{3}{4})f1 \leqq f2 \leqq (5/4)f1$. In a graph shown in FIG. 5, a horizontal axis represents the passage length L between the airflow meter 8 and the throttle valve 11 and a vertical axis represents the ISC drive frequency f1. In this graph, the vibration caused by the driving of the ISC valve 13 becomes problematic in an oblique lined zone. For instance, the case where the passage length L is set at about 0.35 m and the ISC drive frequency f1 is set at about 250 Hz (point A in FIG. 5) is located in this problematic zone since the ISC drive frequency f1 is substantially equal to the characteristic frequency f2 of the upstream intake passage 1.

In this embodiment, the vibration caused by the driving of the ISC valve 13 is amplified due to the resonance in the upstream intake passage 1. However, this vibration is deadened since the resonance chamber 17 is connected to the upstream intake passage 1. This prevents a detection error from occurring in the airflow meter 9, thereby providing a noise deadening action in the intake passage.

Figure 6:
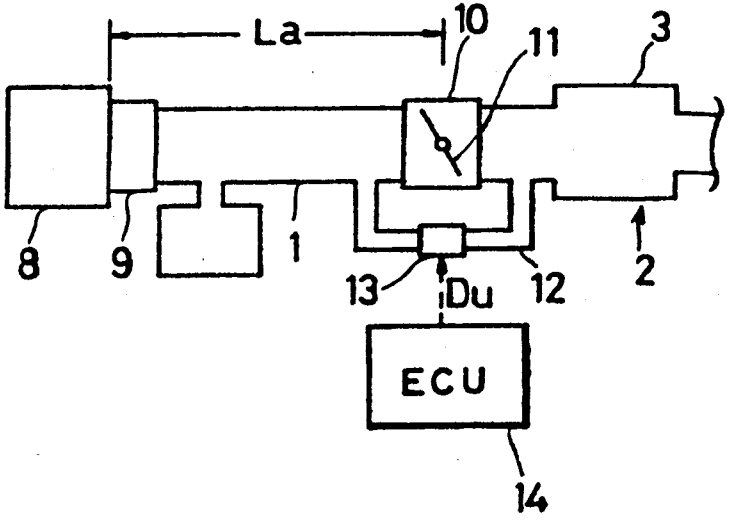
FIG. 6 is a schematic diagram showing an induction system as another embodiment.

FIG. 6 is a schematic diagram showing another embodiment of the invention. In this embodiment as well, an upstream intake passage 1 is provided with an air cleaner 8 serving as a diffuser, a hot-wire airflow meter 9 positioned downstream from the air cleaner 8, and a throttle box 10 incorporating a throttle valve 11 which is located further downstream from the air cleaner 8. The passage 1 is also provided with an ISC pipe 12 bypassing the throttle valve 11. In the ISC pipe 12 is disposed an ISC valve 13 for controlling a flow rate in the pipe 12. The ISC valve 13 is duty controlled in accordance with a duty signal Du output from the control unit 14.

Figure 7:
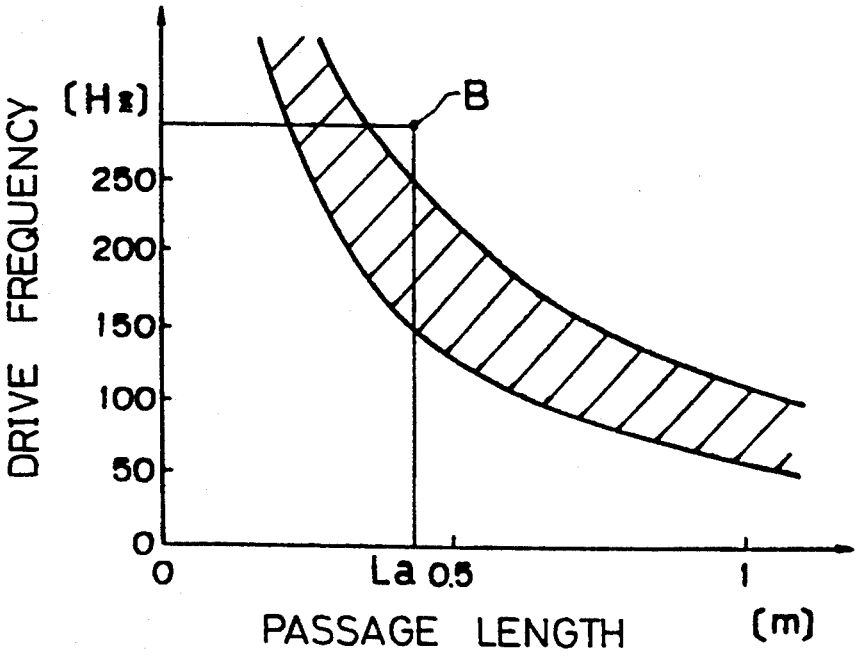
FIG. 7 is a graph showing a zone similar to the one in FIG. 5 and showing the drive frequency as related to the intake passage length in another embodiment shown in FIG. 6.

In this embodiment, a drive frequency when the ISC valve 13 is duty controlled is set higher than a characteristic frequency in the intake passage between the air cleaner 8 and the throttle valve 11 by a specified value or larger. In other words, the ISC drive frequency f1 is set high so as to obtain the following relationship: $f1>(5/4)f2$. This relationship is described with reference to FIG. 7. The ISC drive frequency f1 is set above an oblique lined zone (a zone where the vibration caused by the driving of the ISC valve 13 becomes problematic similarly to the one shown in FIG. 5) at a given passage length. For instance, in the case where the length of the upstream intake passage 1 is set at a value La shown in FIG. 7, the ISC drive frequency f1 is set at a level indicated by a point B above the oblique line zone.

An action of this embodiment will be described while comparing with the conventional induction system. In the conventional induction system of this type, the ISC drive frequency is set relatively low and the length of the upstream intake passage is subject to limitation in terms of the layout. Accordingly, the ISC drive frequency is set so as to be located in the oblique lined zone in FIG. 7 or therebelow at a given characteristic frequency of the upstream intake passage. However, the aforementioned vibrational problem occurs when the ISC drive frequency is set in the oblique lined zone, whereas the responsiveness of the duty control and the like are deteriorated when the ISC drive frequency is set below the oblique line zone. Contrary to this, according to the system of this embodiment, the vibration caused by the driving of the ISC valve 13 is prevented from resonating and the responsiveness of the duty control and the like are improved since the ISC drive frequency f1 is set high as described above.

In the foregoing embodiments, the hot-wire airflow meter is used as an intake air amount detector. However, other types of airflow meters may be effectively used in the invention in the case where the vibration in the intake passage in the idle operating state causes an error in detecting the intake air amount.

According to the invention, in an engine induction system in which a drive frequency f1 when a control valve disposed in a bypass pipe bypassing a throttle valve is duty controlled and a characteristic frequency f2 of an intake passage portion between an upstream located diffuser and the throttle valve are set so as to obtain a relationship: $(\frac{3}{4})f1 \leqq f2 \leqq (5/4)f1$, a resonance chamber is connected to the intake passage portion between the diffuser and the throttle valve. Thus, when the vibration caused by the driving of the control valve is liable to be amplified in an idle operating state because the drive frequency f1 and the characteristic frequency f2 are related to each other as above, the vibration can be deadened effectively and a detection error of an airflow meter resulting from this vibration can be lessened.

Further, the drive frequency of the duty control for the control valve is set higher than the characteristic frequency of the intake passage portion between the diffuser and the throttle valve by a specified value or larger. Accordingly, the vibration caused by the driving of the control valve is prevented from resonating in the intake passage to thereby lessen the detection error of the airflow meter resulting from the vibration, while improving the responsiveness of the duty control and the like.

In the case where a hot-wire airflow meter is used as an intake air amount detector, the detection accuracy of the airflow meter can be advantageously attained in view of the construction of the induction system according to the invention.

Although the present invention has been fully described by way of example with reference to the accompanying drawings, it is to be understood that various changes and modifications will be apparent to those skilled in the art. Therefore, unless such changes and modifications depart from the scope of the present invention, they should be construed as being included therein.

What is claimed is:

1. An engine induction system comprising:

an intake passage:

an diffuser positioned upstream from the intake passage;

a detector means disposed downstream from the diffuser for detecting an amount of intake air flowing through the intake passage;

a throttle valve disposed downstream from the detector means;

a bypass pipe bypassing the throttle valve; and a control valve for controlling a flow rate in the bypass pipe, the control valve being duty controlled according to an operating state of an engine, the control valve being a solenoid valve having a valve member which is opened and closed according to the duty cycle control;

a control unit outputting a signal for operating the control valve at a drive frequency, wherein the drive frequency of the control valve for the duty control is set higher than a characteristic frequency of the intake passage between the diffuser and the throttle valve by a specified value or larger.

2. An engine induction system according to claim 1 wherein the detector means is a hot-wire airflow meter.

* * * * *